US009145640B2

(12) United States Patent
Li et al.

(10) Patent No.: US 9,145,640 B2
(45) Date of Patent: Sep. 29, 2015

(54) ENZYMATIC TREATMENT OF WOOD CHIPS

(71) Applicant: UNIVERSITY OF NEW BRUNSWICK, Fredericton (CA)

(72) Inventors: Kecheng Li, Fredericton (CA); Andre Pelletier, Federicton (CA)

(73) Assignee: UNIVERSITY OF NEW BRUNSWICK, Fredericton, ON (CA)

( * ) Notice: Subject to any disclaimer, the term of this patent is extended or adjusted under 35 U.S.C. 154(b) by 0 days.

(21) Appl. No.: 13/755,815

(22) Filed: Jan. 31, 2013

(65) Prior Publication Data

US 2014/0209260 A1 Jul. 31, 2014

(51) Int. Cl.

| | |
|---|---|
| ***D21B 1/02*** | (2006.01) |
| ***D21C 3/20*** | (2006.01) |
| ***D21C 5/00*** | (2006.01) |

(52) U.S. Cl.

CPC ..... *D21B 1/021* (2013.01); *D21C 5/005* (2013.01)

(58) Field of Classification Search

CPC ..... D21C 5/005; D21C 3/20; D21C 3/222; D21H 17/005; D21B 1/021; D21B 1/02; D21B 1/345; D21B 1/16; C12P 2201/00; C12P 1/02; C12P 1/04

USPC ..... 162/9, 24–26, 70, 72; 241/21

See application file for complete search history.

(56) References Cited

U.S. PATENT DOCUMENTS

| | | | | |
|---|---|---|---|---|
| 5,169,497 | A * | 12/1992 | Sarkar et al. | 162/158 |
| 5,725,732 | A * | 3/1998 | Cooper, III | 162/72 |
| 5,750,005 | A | 5/1998 | Akhtar | |
| 5,813,617 | A | 9/1998 | Thoma | |
| 5,865,949 | A | 2/1999 | Pere et al. | |
| 5,874,293 | A * | 2/1999 | Miettinen-Oinonen et al. | 435/263 |
| 5,922,579 | A * | 7/1999 | Fagerstrom et al. | 435/99 |
| 6,099,688 | A | 8/2000 | Pere et al. | |
| 6,146,494 | A * | 11/2000 | Seger et al. | 162/9 |
| 6,267,841 | B1 * | 7/2001 | Burton | 162/24 |
| 6,287,708 | B1 | 9/2001 | Viikari et al. | |
| 7,008,505 | B2 | 3/2006 | Akhtar et al. | |
| 7,922,705 | B2 | 4/2011 | Ampulski | |
| 8,394,237 | B2 * | 3/2013 | Klein et al. | 162/164.6 |
| 2005/0000666 | A1 | 1/2005 | Taylor et al. | |
| 2005/0181485 | A1 * | 8/2005 | Tsukamoto et al. | 435/101 |
| 2007/0029059 | A1 * | 2/2007 | Elgarhy et al. | 162/72 |
| 2007/0151683 | A1 | 7/2007 | Pere et al. | |
| 2009/0117634 | A1 | 5/2009 | Bradley et al. | |
| 2011/0168344 | A1 * | 7/2011 | Klein et al. | 162/164.6 |
| 2011/0250638 | A1 * | 10/2011 | Sjoede et al. | 435/68.1 |
| 2014/0106407 | A1 * | 4/2014 | Zhu | 435/99 |
| 2014/0209259 | A1 | 7/2014 | Li et al. | |
| 2014/0209260 | A1 * | 7/2014 | Li et al. | 162/72 |
| 2014/0209261 | A1 * | 7/2014 | Fougere et al. | 162/82 |

FOREIGN PATENT DOCUMENTS

| | | | |
|---|---|---|---|
| CA | 758488 | | 5/1967 |
| CA | 2030836 | A1 | 5/1991 |
| CA | 2109111 | | 10/1992 |
| EP | 1699974 | | 7/2009 |
| WO | 9628606 | | 9/1996 |
| WO | 9740194 | | 10/1997 |
| WO | WO 2005056915 | A1 * | 6/2005 |
| WO | 2011130503 | A2 | 10/2011 |

OTHER PUBLICATIONS

Novozymes, Cellulclast® 1.5 Product Data Sheet, Mar. 9, 2009, Novozymes , pp. 1-2.*

Ghose, T.K, "Measurement of Cellulase Activities", Pure & Appl. Chem. vol. 69, No. 2, pp. 257-268, 1987.

Ratto, M. and Poutanen, K., "Production of Mannan-Degrading Enzymes", Biotechnology Letters, vol. 10, No. 9, pp. 661-664, 1988.

Miller, G.L., "Use of dinitrosalicylic Acid Reagent for Determination of Reducing Sugar", Analytical Chem., vol. 31, No. 3, pp. 426-428, Mar. 1959.

Broda, P., "Biotechnology in the degradation and utilization of lignocellulose", Biodegradation 3:219-238 1992.

Kovacs, K. et al., (Krisztina Kovacs, Stefano Macrelli, George Szakacs and Guido Zacchi, "Enzymatic hydrolysis of steam-pretreated lignocellulosic materials with *Trichoderma atroviride* enzymes produced in-house" Biotechnology for Biofuels. Biotechnology for Biofuels 2009, 2:14).

J. D. Richardson et al., "Modification of Mechanical Pulp using Carbohydrate-Degrading Enzyme", J. Pulp Paper Sci. 24(4): 125-129 (1998).

A. C. Engstrom et al., "Improved Accessibility and Reactivity of Dissolving Pulp for the Viscose Process, Pretreatment with Monocomponent Endoglucanase", Biomacromolecules 7(6): 2027-2031, Jun. 2006.

T. M. Wood et al., "Mechanism of Fungal Cellulase Action", Biochem. J. 260: 37-43 (1989).

J. Pere et al., "Biomechanical Pulping with Enzymes: Response of Coarse Mechanical Pulp to Enzymatic Modification and Secondary Refining", Tappi Journal 83(5): 1-8, May 2000.

(Continued)

*Primary Examiner* — Jose Fortuna

(74) *Attorney, Agent, or Firm* — Lynn C. Schumacher; Hill & Schumacher

(57) ABSTRACT

A process using a multicomponent enzyme preparation to treat chips that have been crushed using a device that combines shear and compressive forces where treatment occurs mainly during decompression and reduces the specific energy consumption and/or increasing production of subsequent refining while maintaining or increasing handsheet physical properties. The enzyme preparation is to have a major endoglucanase activity, a significant mannanase activity and a slight cellobiohydrolase activity. This enzyme mixture is prepared from a genetically modified strain of *Trichoderma reseii*.

23 Claims, 2 Drawing Sheets

(56) References Cited

OTHER PUBLICATIONS

Authors: Andre Pelletier, Kecheng Li, George Court, Martin Fairbank, and Mark Frith, Enzymatic Pre-treatment of Wood Chips for Energy Savings in TMP Refining, Journal: Journal of Science & Technology for Forest Products and Processes, vol. 4(1) pp. 34-49 Date: 2014.

Authors: Andre Pelletier, Kecheng Li, Yu Zhao, George Court, James Luo, and Mark Frith, Improvement of Enzyme Transport in Wood Chips for Thermomechanical Pulp Refining, Journal: Carbohydrate Polymers, vol. 95, pp. 25-31 Date: Feb. 26, 2013.

Authors: Andre Pelletier, Yu Zhao, Xiaochun Lei, and Kecheng Li, Improved Fiber Separation and Energy Reduction in Thermomechanical Pulp Refining using Enzyme-Pretreated Wood, Journal: bioresources.com, vol. 8(3) pp. 3385-3398 Date: May 10, 2013.

* cited by examiner

ENZYMATIC TREATMENT OF WOOD CHIPS

FIELD OF THE INVENTION

The invention relates to enzymatic pretreatment of wood chips to improve the chips for downstream processing, such as lowered energy consumption during refining of the chips.

BACKGROUND

Wood pulps are generally produced through multistep processes. Initially, logs can be subjected to grinding in which the logs are forced against a rotating abrasive stone which separates the fibers from the log and also the wood cell matrix. In a refining process, wood chips are fed between two metal discs, with at least one disc rotating. In both cases, essentially all of the constituents of wood are retained in the pulp that is eventually produced. Such pulp contains fiber bundles, fiber fragments and whole fibers. A lack of uniformity of pulp and constituents and the presence of lignin in the pulp give it certain desirable qualities, such as yield, paper bulk and opacity as well as good printability. The pulp also has less desirable properties for some paper types, such as low strength, relatively coarse surface and a lack of durability.

Chips to be refined can be destructured and impregnated with chemicals or enzymes prior to further mechanical treatment. This can help increase pulp quality or reduce energy consumption. These methods create slightly different pulps and also vary with the species of wood species, quality of the wood, processing conditions and the amount of energy applied. Various forms exist: thermomechanical pulping (TMP), refiner pulping, stone groundwood pulping, etc.

Chip "destructuring" is usually carried out in the first stage refiner where it occurs in combination with some fiber fibrillation. The difficulty of clearly separating these two steps can lead to an unnecessary increase in energy while no significant gain in pulp properties is obtained. Several pieces of equipment have been developed to overcome these drawbacks. U.S. Pat. No. 5,813,617 of Toma, for example, describes one such device. Other devices incorporate compressive forces along with the destructuring shear forces. These compressive forces along with the accompanied decompression can be used to enhance the penetration of chemicals or enzymes for impregnation prior to refining.

In TMP, steam is added to the chips being refined to facilitate pulping and lower electricity consumption. Steam is also produced during refining and heat recovery systems can help recoup some of the energy cost of the process. The electric motors used to operate these refiners require very large amounts of power. The TMP process generally involves several refining stages to produce a desirable pulp. However, only a small portion of the energy used in each refining stage is actually used to separate and develop the fibers. Screening is used after or between refining stages to separate adequately refined fibers from longer, coarser fibers. These tougher fibers are sent to "rejects" refiners for further development. Depending on the quality of refining, the amount of rejects needing additional refining can and usually is significant.

Woody biomass used in these mechanical pulping processes contains cellulose, hemicelluloses, lignin and extractives in varying amounts throughout the ultrastructure of its fibers. These various components act in conjunction to give these substrates mechanical strength and resistance to degradation. By selectively removing or altering certain components, it is possible to reduce the amount of energy required to separate and refine these fibers. The patent literature describes various approaches using different enzyme mixtures. For example US Patent Publication No. 2005/0000666, of Taylor et al., describes the use of mannanase and xylanase. Certain treatments have been found to significantly impact paper strength properties which have limited their applications. U.S. Pat. No. 5,865,949, of Pere et al., describes a process using an enzyme mixture containing endo-β-glucanase (EG), a limited mannanase and cellobiohydrolase (CBH) activity which reduces the negative effects on paper strength. U.S. Pat. No. 6,099,688, of Pere et al., describes the use of isolated cellobiohydrolase to increase the amount of relative amorphousness of the cellulose within the fibers. This process is said to cause even less damage to paper properties.

International patent publication No. WO 97/40194, of Eachus et al., suggests changing the structure or the composition of the wood by adding to compressed chips fungal or bacterial cultures or products, such as enzymes obtained from them, by means of pressure. The purpose of the compression is to make cracks and fractures in the wood. When the chips are released from the compression, microbes of their products, while the chips expand, are absorbed by the structures of the wood partially by the virtue of negative pressure, partially by the capillary action. The use of lipolytic, proteolytic, linginolytic, cellulolytic and hemicellulolytic enzymes is mentioned. The patent specification describes the absorption of the enzyme preparation Clariant Cartazyme HS™ into the compressed chips after releasing the pressure. Liquid was removed after the treatment, and mechanical pulp was prepared from the chips. In that case, the amount of energy consumed was 7.5% less than in the case of chips that were treated with a buffer only. In another test, the enzyme preparations Clariant Cartazyme NS™ and Sigma porcine pancreas Lipase L-3126 were used. In that case, the amount of energy consumed was 12.5% less than when treated with a buffer only.

A more recent pre-treatment of chips using an enzyme preparation containing cellobiohydrolase and endoglucanase was suggested by Pere in United States Patent Publication No. 2007/0151683. Here again, it was said to be preferable to carry out the enzymatic treatment by compressing the chips and by bringing the compressed chips in a liquid phase into contact with the enzyme composition to absorb the enzyme composition into the chips. The process is said to be useful for reducing the specific energy consumption (SEC) of mechanical pulp and to improve the technical properties of the fibers.

SUMMARY

The invention provides a method for preparing mechanical pulp. The method includes: (i) exposing compressed wood chips to an enzymatic solution comprising an endoglucanase (EG) and a cellobiohydrolase (CBH), wherein the ratio of enzymatic activity of EG:CBH is at least 3, and permitting the wood chips to decompress. The product of step (i) can be refined for further processing in the production e.g. of pulp for the manufacture of paper products.

The enzymatic activity of the CBH in the enzymatic solution is typically at least 0.5 FPU per gm of wood chips. The dry weight of the wood substrate can be measured according to standard T 258 om-06. It is possible use CBH in an amount that provides greater activity e.g., in a range from 0.5 to 200 FPU, or 1 to 150 FPU, or 5 to 150, or 10 to 150, or 20 to 150, or 30 to 150, or 40 to 150, or 50 to 150, or 70 to 150, or 100 to 150 FPU, or 50 to 130 FPU, or 50 to 110 FPU per gram of wood chips etc., or the activity can be about any of the foregoing values. A preferred range is between 0.1 and 5 FPU per gm of wood chips.

In embodiments, the enzymatic solution also contains a hemicellulase, typically the enzymatic activity of the hemicellulase being at least 1.5 times the activity of the CBH. A preferred hemicellulase is a mannanase (MAN).

As described in the examples, wood chips can be exposed to the enzymatic solution for sufficient time to reduce energy consumption during subsequent refining of the wood chips to pulp in which the freeness of the pulp (CSF) obtained is reduced by at least 5% in comparison to the freeness of pulp obtained by refining chips which have not been exposed to the enzymatic solution. The energy reduction can be at least 5%, but can be greater e.g., at least 6%, at least 7%, at least 8%, at least 9%, at least 10%, at least 11% or at least 12%, or can be about any of these amounts.

Suitable enzymatic activity is provided by EG, CBH, and MAN classified as EC 3.2.1.6, EC 3.2.1.91, and EC 3.2.1.78, respectively.

Enzymatic activity of the EG can be at least 1850 CMCU per gm of wood chips and/or MAN is at least 250 IU per gm of wood chips.

The enzymatic solution can contain enzymatic protein having of between 0.02 mg/g to 20 mg/g of the wood chips.

Wood chips can be softwood, for example, Black Spruce, *Picea mariana*, used in the examples described below. The chips can be made up of from 38 to 52% by weight cellulose, from 20 to 30% by weight lignin, from 20 to 30% by weight hemicellulose. The hemicellulose component can be from 15 to 20% mannans by total weight of the wood chips and from 15 to 20% xylans by total weight of the wood chips.

In preferred embodiments, the wood chips are destructured wood chips having an average weight per chip in the range of from 0.8 to 2 g.

The method can include the step of compressing wood chips to form the compressed wood chips that are to be permitted to be decompressed while exposed to the enzymatic solution.

The wood chips can be subjected to steaming prior to being compressed.

Wood chips having an average size of, prior to compression, between 15 to 35 mm long by 15 to 35 mm wide and between 2 to 8 mm thick are suitable.

Compressing the wood chips can include subjecting the chips to a pressure in the range of from 50 to 600 atm. A preferred minimum pressure is 100 atm.

In an embodiment, wood chips are compressed by at least 10% of their uncompressed volume.

Compression of the wood chips can be accomplished through the use of e.g., screw clamp, or press or, a hydraulic press. Compression can include the chips to pressure for a period of between 10 minutes and 5 hours. In many cases, 10 to 30 minutes is acceptable.

Compression of the wood chips can be conducted prior to exposing of the compressed wood chips to the enzymatic solution or in the presence of the enzymatic solution.

Decompression can take place at atmospheric pressure in an aqueous solution for a period of time in which a final consistency in the range of from 0.3 to 30% is reached, preferably a range of from 5 to 15%.

Refining the wood chips that have been enzymatically treated can be conducted to obtain a mechanical wood pulp having a drainability of at least 100 ml CSF.

The method can also include chipping raw wood material to form wood chips which can then be compressed and destructured for enzymatic treatment.

An embodiment of the invention is also a method for treating wood chips for eventual use in preparing mechanical pulp e.g., refining. In this sense, the embodiment can be regarded as a method for preparing feedstock for a mechanical pulping process. The method includes exposing compressed wood chips to an enzymatic solution comprising an endoglucanase (EG) and a cellobiohydrolase (CBH), wherein the ratio of enzymatic activity of EG:CBH is at least 3. Other features associated with the enzymatic treatment, described above, and below in connection with the examples, can of course be included in this treatment. Downstream processing can include subjecting treated wood chips to mechanical pulping, which can be a thermomechanical refining process or a chemithermomechanical refining process. A paper product can be manufactured downstream, be it in a separate mill or as part of an in-line process.

So, an aspect of the present invention is a method for reducing the amount of energy required to refine destructured chips by treating said chips with an enzymatic solution containing a plurality of enzymes and optionally stabilizer compound(s) during decompression. This solution can be a combination of CBH, EG, mannanase and stabilizer agents and surfactants containing mainly propylene glycol, glycerol, sorbitol and to a lesser degree proxel, potassium sorbate and ethoxylated fatty alcohols. The enzymatic treatment can be carried out at process temperatures of from 20° C. to 80° C., for example between 40° C. and 60° C. The enzymatic treatment can be carried out at a pH of from about 2 to about 10. The treatment time can be from 30 minutes to 10 hours. Other temperatures, pHs and or times can be used.

The reduction in energy can be manifest as reduced energy consumption during primary, secondary, tertiary, reject, post-refining or other mechanical treatment used to obtain a desired final pulp from a destructured wood chip that has been treated with the enzyme solution prior to refining.

The enzyme solution used herein preferably possesses the following relative activities: the EG should have a 10 fold greater activity than the CBH and the mannanase should have a 2 fold greater activity than the CBH. This enzyme solution is available commercially from Novozymes® under the name Celluclast 1.5L™.

Methods of refining chips with lower energy requirements to obtain a desirable degree of refining are set forth herein. Methods for refining the chips wherein the refining process includes mechanical destructuring including compression and decompression, of wood chips followed by treatment of the obtained destructured chips with a complex enzyme mixture are presented, wherein the resultant pulp and/or paper products have maintained tensile strength, improved optical properties and slightly reduced tear index as compared to untreated pulps or products therewith.

Pulp and paper products made therefrom having maintained tensile strength, improved optical properties and slightly reduced tear strength are provided. Pulp and papers made therefrom which require less energy to produce are provided.

It is to be understood that both the foregoing general description and the following detailed description are exemplary and explanatory only and are only intended to provide a further explanation of the present invention as claimed

BRIEF DESCRIPTION OF THE DRAWINGS

Embodiments illustrating the invention and establishing feasibility of various aspects thereof are described below with reference to the accompanying drawings, in which.

DETAILED DESCRIPTION

Figure 1:
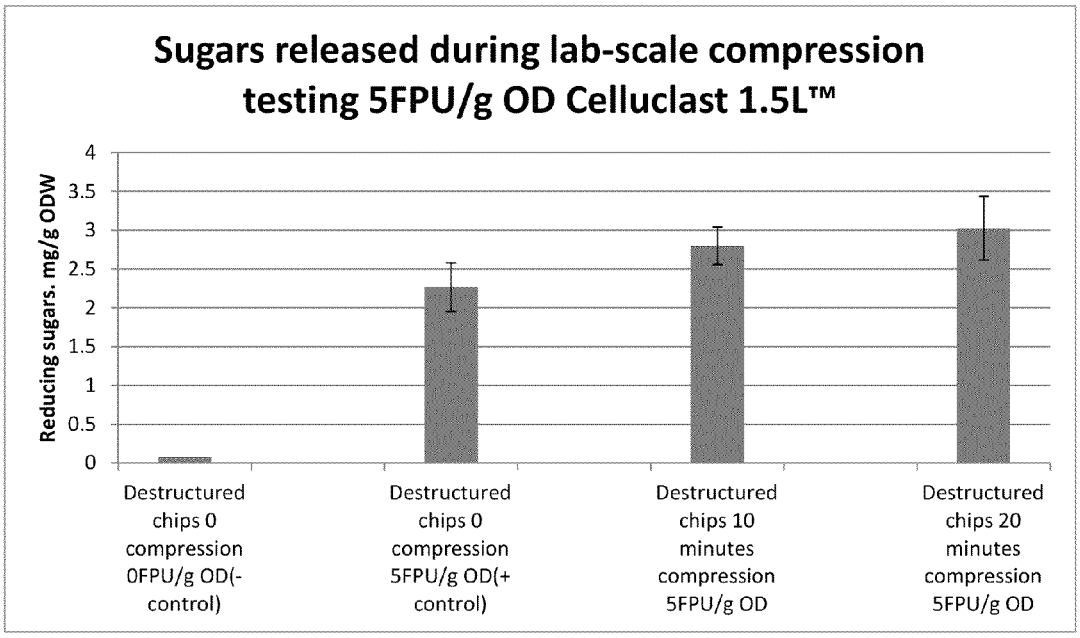
FIG. 1 is a bar graph showing the amount of sugars released per gram of oven dried chips (OD) into the liquor after a 1 hour enzyme hydrolysis (5 FPU/g OD Celluclast 1.5L™) at different compression conditions.

The present invention relates to a method of refining chips into pulps, wherein the method includes the use of an enzyme mixture containing cellulases and hemicellulase. Treatment with this solution following chip destructuring, compression and decompression prior to the entire refining process from primary, secondary, reject to post refining can reduce the energy required to reach a given degree of refining. This enzyme mixture is to contain a significant EG activity, a marked mannanase activity and a CBH activity that is lower than the first two but not negligible.

As used herein, an endo-β-glucanase is preferably a cellulase classified as EC 3.2.1.6—endo-1,3(4)-β-glucanase. This enzyme is preferably capable of endohydrolysis of 1,3- or 1,4-linkages in β-D-glucans when the glucose residue whose reducing group is involved in the linkage to be hydrolysed is itself substituted at C-3. This hydrolysis cleaves the O-glycosyl bond of the cellulose backbone.

As used herein, a "mannanase" is preferably a hemicellulase classified as EC 3.2.1.78, and called endo-1,4-β-mannosidase. Mannanase includes β-mannanase, endo-1,4-mannanase, and galactomannanase. Mannanase is preferably capable of catalyzing the hydrolysis of 1,4-β-D-mannosidic linkages in mannans, including glucomannans, galactomannans and galactoglucomannans. Mannans are polysaccharides primarily or entirely composed of D-mannose units.

As used herein, a cellobiohydrolase is preferably a cellulase classified as EC 3.2.1.91 and called cellulose 1,4-β-cellobiosidase (non-reducing end). This enzyme produces the hydrolysis of (1→4)-β-D-glucosidic linkages in cellulose and cellotetraose, releasing cellobiose from the non-reducing ends of the chains EG activity can be determined following the carboxymethyl cellulose (CMC) method described in *Measurement of Cellulase Activities* by T. K. Ghose (Pure & Appl. Chem. Vol 69, No. 2, pp. 257-268, 1987). The amount of reducing sugars released from enzymatic hydrolysis of a 2% solution of a well characterized CMC is used to determine the enzymes EG activity. Sugar concentration is determined by the well known DNS method described by G. L. Miller (Analytical Chem., No. 31, p. 426, 1959).

CBH activity can be determined following the filter paper assay method described in *Measurement of Cellulase Activities* by T. K. Ghose (Pure & Appl. Chem. Vol 69, No. 2, pp. 257-268, 1987). The amount of reducing sugars released from enzymatic hydrolysis of Whatman No. 1 filter paper strip of known size is used to determine the enzymes CBH activity. Sugar concentration is determined by the well known DNS method described by G. L. Miller (Analytical Chem., No. 31, p. 426, 1959).

Mannanase activity can be determined following the method describer by M. Ratto and K. Poutanen (Biotechnology Letters, No 9, pp-661-664, 1988). The amount of reducing sugars released from enzymatic hydrolysis of a 0.5% solution of locust bean gum is used to determine the enzymes mannanase activity. Sugar concentration is determined by the well known DNS method described by G. L. Miller (Analytical Chem., No. 31, p. 426, 1959).

An enzyme solution containing EG, CBH and mannanase activities in the correct ratios is commercially available from Novozymes® under the name Celluclast 1.5L™. This solution contains between 40 mg and 50 mg of total protein per milliliter of solution. When kept at between 0° C. and 25° C., the solution is stable and its activity is maintained for about 18 months. Storage at higher temperatures will reduce this effective storage time.

The enzyme solution can vary slightly in ratio of activities which still give the desired energy reductions and paper qualities. The amount of total protein in the correct ratio should be between 0.02 kg and 5 kg per metric ton of oven dried wood. This amount of total protein can vary depending on the type of woody substrate being used, for example virgin hardwood kraft, virgin softwood kraft, recycled pulp, groundwood, refiner groundwood, pressurized refiner groundwood, thermomechanical, chemithermomechanical or a mixture thereof; or the species of wood which makes up this substrate, for example *Populus* sp., *Acer* sp., *Picea* sp., *Abies* sp., *Pinus* sp., *Conium* sp., etc.

The destructured chips of the present invention can be treated with one or more other components, including polymers such as anionic and non-ionic polymers, clays, other fillers, dyes, pigments, defoamers, microbiocides, pH adjusting agents such as alum or hydrochloric acid, other enzymes, and other conventional papermaking or processing additives. These additives can be added before, during or after introduction of the enzyme solution. The enzyme solution can be added, and is preferably added to the papermaking pulp before the addition of coagulants, flocculants, fillers and other conventional and non-conventional papermaking additives, including additional enzymes.

The destructured chips can be any conventional softwood or hardwood species used in mechanical pulp production, such as spruce, fir, hemlock, aspen, acacia, birch, beech, eucalyptus, oak and other softwood and hardwood species. The destructured chips can contain cellulose fibers at a concentration of at 35% by weight based on the oven dried solids content of the wood. The final pulp can be, for example, virgin pulp (e.g. spruce, fir, pine, eucalyptus, and include virgin hardwood or virgin softwood), hardwood kraft, softwood kraft, recycled pulp, groundwood, refiner groundwood, pressurized refiner groundwood, thermomechanical, chemithermomechanical or mixtures thereof.

According to various embodiments, the papermaking system can include chip handling equipment with a chip destructuring device which is capable of destructuring and compressing wood chips, a primary refiner, a secondary refiner, a screen, a mixer, a latency and/or blend chest, and papermaking equipment, for example, screens. The papermaking system can also include metering devices for providing a suitable concentration of the enzyme composition or other additives to the flow of pulp. Valving, pumps, and metering equipment as known to those skilled in the art can also be used for introducing various additives described herein to the pulp.

According to one embodiment, the enzyme solution can be added to the chips before or during destructuring, compression or preferably immediately after compression ends and decompression begins, added to pulp after the pulp leaves the first refiner (also known as the primary refiner) during the refining process. For example, the enzyme solution can be added before the second refiner (also known as the secondary refiner), after the second refiner, before the screen, after the screen, before the mixer, after the mixer, before the latency and/or blend chest, to the latency and/or blend chest. For example, the enzyme solution can be added after the second refiner, between the screen and the mixer, or after the mixer. Other additives as described can be added to the papermaking system as known to those skilled in the art.

The destructured chips can be treated with the enzyme solution when the chips are at a temperature of from 10° C. to about 75° C., from about 30° C. to about 70° C., or from about 40° C. to about 65° C. The chips can be at a pH of from 2 to 10, from about 4 to 7, or from 4.5 to 5.5. A treatment time can be from 10 minutes to about 10 hours, from about 30 minutes to about 5 hours or from 1 hours to 2 hours.

The enzyme treatment is carried out before, during or immediately after the destructuring process, but before completion of the refining process. The enzyme treatment is carried out on "destructured wood chips". "Destructured wood chips" refers to a woody material used as the raw material of the mechanical pulp, which has been subjected to at least one mechanical destructuring process step. The term destructured wood chips therefore encompasses, e.g. chips of various sizes, compressed and uncompressed destructured wood chips, matchsticks and fiber bundles. Preferably, the enzyme treatment is carried out on destructured wood chips. More preferably the enzyme solution is carried out on destructured wood chips during decompression of the chips.

In another embodiment, the enzyme solution can be added during the chip handling prior to destructuring. As an example, the enzyme solution can be added after chip washing at the chip bin. In this embodiment, the chips are treated and directed to a destructuring device before compression-decompression prior to a primary refiner. The pulp is then refined to desired specifications before being returned to the papermaking system stream.

The introduction of the enzyme solution can be made at one or more points and the introduction can be continuous, semi-continuous, batch, or combinations thereof.

According to various embodiments, the chip to liquor ratio can be about 1 to 20, 1 to 10, or 1 to 5.

Various ranges of components such as enzymatic activities, times, pressures, and values of such are described herein. It is to be understood that additional combinations of such ranges and values are also disclosed by such descriptions. As a general example, a range of from 2 to 5 describes values of about 2 and about 5; values of about 2, 3, 4 and 5 describes ranges of 2 to 5, 3 to 4, 2 to 4, etc.

Chips processed as described herein can exhibit maintained tensile strength, while suffering some loss of tear strength. Paper products made from the pulp also maintain tensile strength while losing some tear strength. The addition of the enzyme solution creates fiber weaknesses which allow the formation of shorter fibers but also enhance fiber fibrillation which is why tear is affected while tensile strength is maintained. Fines production increases, thus lowering freeness at a given specific energy of refining SEC. The addition of the enzyme solution to chips reduces the amount of SEC needed to obtain a desired level of freeness.

A pulp produced by the methods described herein can be used in the production of paper products, including, for example, cardboard, paper towels, newspaper, and hygiene products. The methods described herein can also be suitable for textile manufacturing.

EXAMPLES

Example 1

Enzymatic Activities

The commercial enzyme product, Celluclast 1.5L™, was tested for several enzymatic activities and was found to have several different types of activities. The following table list all relevant and significantly measurable activities and protein concentration.

Carboxymethyl cellulase (CMC) activity, equivalent to endo-β-glucanase activity, was determined following the CMC method described in *Measurement of Cellulase Activities* by T. K. Ghose (Pure & Appl. Chem. Vol 69, No. 2, pp. 257-268, 1987). The amount of reducing sugars released from enzymatic hydrolysis of a 2% solution of a well characterized CMC during a 30.0 minute hydrolysis at pH 4.8 and 50° C. is used to determine the enzymes EG activity. Sugar concentration is determined by the well known 3,5-dinitrosalicylic acid (DNS) solution method described by G. L. Miller (Analytical Chem., No. 31, p. 426, 1959). The addition of the DNS solution to the hydrolysis filtrate stops the reaction. The mixture was boiled for 5.0 minutes to allow for color formation. After cooling, the absorbency is measured at 540 nm and the concentration is determined against a standard curve.

Mannanase activity was determined following the method describer by M. Ratto and K. Poutanen (Biotechnology Letters, No 9, pp-661-664, 1988). The amount of reducing sugars released from enzymatic hydrolysis of a 0.5% solution of locust bean gum during a 30.0 minute hydrolysis at pH 4.8 and 50° C. is used to determine mannanase activity. Sugar concentration is determined by the well known DNS method described by G. L. Miller (Analytical Chem., No. 31, p. 426, 1959) and described thoroughly above.

Filter paper activity, equivalent to CBH activity, was determined following the filter paper assay method described in *Measurement of Cellulase Activities* by T. K. Ghose (Pure & Appl. Chem. Vol 69, No. 2, pp. 257-268, 1987). This method uses the amount of reducing sugars released from enzymatic hydrolysis of Whatman No. 1 filter paper strip of known size during a 30.0 minute hydrolysis at pH 4.8 and 50° C. to determine the enzymes CBH activity. Sugar concentration is determined by the well known DNS method described by G. L. Miller (Analytical Chem., No. 31, p. 426, 1959) and described thoroughly above.

Protein concentration was determined using the Bradford assay. Bradford assay kits purchased from Sigma-Aldrich were used. This well known method uses the binding of protein with a solution of Coomassie Blue which allows colorimetric determination of protein concentration based on a standard curve produced using bovine serum albumin. Absorbency is measured at 595 nm.

Measured parameters of Celluclast 1.5L ™

| Parameter | Value | Unit |
|---|---|---|
| Endo-β-glucanase | 1860 | CMC/ml |
| Mannanase activity | 285 | IU/ml |
| Cellobiohydrolase | 150 | FPU/ml |
| Total protein | 43.4 | mg/ml |

Example 2

Sugars Released

The enzyme solution was added to destructured chips (200 g ODP) using the solutions filter paper activity as a dosage indicator. Different compression conditions at 5 FPU/g OD (10 and 20 minutes held under compression) and controls were done in duplicate and measured in duplicate for a total of four data sets. Hydrolysis was carried out at a consistency of 10%, a temperature of 50° C. and a time of 1 hour. After which, the samples were filtered and the filtrate was treated using the well known 3,5-dinitrosalicylic acid (DNS) solution method described by G. L. Miller (Analytical Chem., No. 31, p. 426, 1959). The addition of the DNS solution to the hydrolysis filtrate stops the reaction. The mixture was boiled for 5.0 minutes to allow for color formation. After cooling, the absorbency is measured at 540 nm and the concentration is determined against a standard curve. This is also shown in FIG. 1.

Sugars released during lab-scale compression testing 5 FPU/g OD Celluclast 1.5L ™

| Treatment | Sugars released into liquor (mg/g ODP) | Standard deviation (mg/g ODP) |
|---|---|---|
| Destructured chips 0 compression 0 FPU/g OD (−control) | 0.08 | 0 |
| Destructured chips 0 compression 5 FPU/g OD (+control) | 2.27 | 0.31 |
| Destructured chips 10 minutes compression 5 FPU/g OD | 2.80 | 0.24 |
| Destructured chips 20 minutes compression 5 FPU/g OD | 3.03 | 0.41 |

Example 3

Freeness

Figure 2:
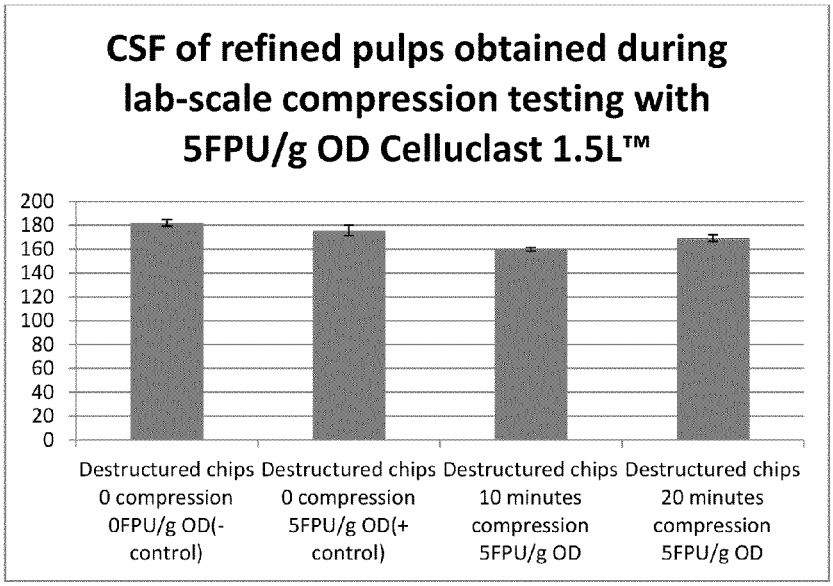
FIG. 2 is a bar graph showing freeness (CSF) after a 1 hour enzyme hydrolysis (5 FPU/g OD Celluclast 1.5L™) at different compression conditions.

The enzyme solution was added to destructured chips (200 g ODP) using the solutions filter paper activity as a dosage indicator. Different compression conditions at 5 FPU/g OD (10 and 20 minutes held under full compression) and a control were done in duplicate. Hydrolysis was carried out at a consistency of 10%, a temperature of 50° C. and a time of 1 hour. After this treatment, chips were dewatered to 20% consistency and refined in three stages using a KRK refiner with disc gaps of 0.5, 0.3 and 0.15 mm. Refined pulp was collected and moisture was checked prior to measuring Canadian Standard Freeness (CSF). Results are shown in the following table and FIG. 2.

Freeness of pulp treated with Celluclast 1.5L ™ trials before refining

| Treatment | CSF (ml) | Standard deviation (ml) |
|---|---|---|
| Destructured chips 0 compression 0 FPU/g OD (−control) | 182 | 3 |
| Destructured chips 0 compression 5 FPU/g OD (+control) | 176 | 4 |
| Destructured chips 10 minutes compression 5 FPU/g OD | 160 | 2 |
| Destructured chips 20 minutes compression 5 FPU/g OD | 169 | 3 |

Example 4

Energy Savings

Figure 3:
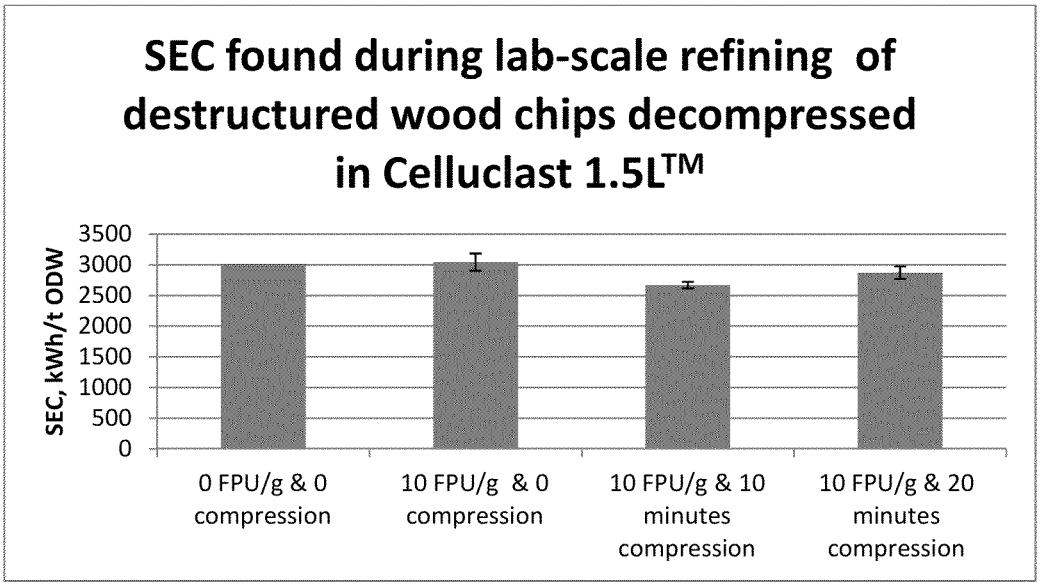
FIG. 3 is a bar graph showing specific energy consumption (SEC) during laboratory scale refining of wood chips that had been compressed at different conditions and subjected to enzyme hydrolysis (10 FPU/g OD Celluclast 1.5L™) for one hour during decompression i.e., at atmospheric pressure.

The enzyme solution was added to destructured chips (200 g ODP) using the solutions filter paper activity as a dosage indicator. Different compression conditions at 10 FPU/g OD (10 and 20 minutes held under full compression) and a control were done in duplicate. Hydrolysis was carried out at a consistency of 10%, a temperature of 50° C. and a time of 1 hour. After this treatment, chips were dewatered to 20% consistency and refined in three stages using a KRK refiner with disc gaps of 0.5, 0.3 and 0.15 mm and a control were done in duplicate. Energy consumption was monitored with an online monitor and networked computer. Results are shown in the following table and in FIG. 3.

Specific energy consumption (SEC) obtained during refining of destructured wood chips treated with Celluclast ™ 1.5L

| Treatment | Net SEC average (kWh/t) | Standard deviation (kWh/t) | Energy savings (%) |
|---|---|---|---|
| Destructured chips 0 compression 0 FPU/g OD (−control) | 3018.5 | 0 | 0 |
| Destructured chips 0 compression 10 FPU/g OD (+control) | 3046 | 53.0 | +0.91 |
| Destructured chips 10 minutes compression 10 FPU/g OD | 2671 | 102.5 | −11.5 |
| Destructured chips 20 minutes compression 10 FPU/g OD | 2873.5 | 99.0 | −4.8 |

* No-load energy consumption (3 minutes of warm up energy was calculated to be 0.12456 kWh) was subtracted from the meter reading to give the net energy consumption All patents, applications and publications mentioned above and throughout this disclosure are incorporated in their entirety by reference herein.

What is claimed is:

1. A method for preparing thermomechanical pulp (TMP), the method comprising the steps of:

(i) exposing compressed wood chips to an enzymatic solution for a period of time from about 30 minutes to about 2 hours at a temperature between 20 and 80° C. and within a pH between 2 and 10, the solution comprising an endoglucanase (EG), a cellobiohydrolase (CBH), and a mannanase (MAN) wherein the ratio of enzymatic activity of EG:CBH is at least 10 and of MAN:CBH is at least 1.5, and permitting the wood chips to decompress; and (ii) refining the product of step (i) to produce the thermomechanical pulp, wherein the pulp has a freeness below about 200 ml CSF after 2 to 3 refining steps, wherein the enzymatic activity of the CBH is in a range from 0.5 to 200 FPU per gm of wood chips, based on dry weight measured according to standard T 258 om-06.

2. The method of claim 1, wherein the wood chips are exposed to the enzymatic solution for a sufficient amount of time to reduce energy consumption during subsequent refining of the wood chips to pulp in which the freeness of the pulp (CSF) obtained is reduced by at least 5% in comparison to the freeness of pulp obtained by refining chips which have not been exposed to the enzymatic solution.

3. The method of claim 2, wherein said energy reduction is at least 5%.

4. The method of claim 3, wherein said energy reduction is at least 10%.

5. The method of claim 4, wherein said EG is classified as EC 3.2.1.6, said CBH is classified as EC 3.2.1.91, and said MAN is classified as EC 3.2.1.78.

6. The method of claim 5, wherein the enzymatic activity of said EG is 5 to 2000 CMCU per gm of wood chips, based on dry weight measured according to standard T 258 om-06.

7. The method of claim 6, wherein the enzymatic activity of MAN is 0.75 to 300 IU per gm of wood chips, based on dry weight measured according to standard T 258 om-06.

8. The method of claim 1, wherein the enzymatic solution contains protein having said enzymatic activity in the amount of between 0.02 kg to 50 kg per metric ton of the wood chips, based on dry weight measured according to standard T 258 om-06.

9. The method of claim 8, wherein the wood chips are softwood.

10. The method of claim 9, wherein said wood chips comprise from 38 to 52% by weight cellulose, from 20 to 30% by weight lignin, from 20 to 30% by weight hemicelluloses.

11. The method of claim 10, wherein the hemicellulose comprises from 15 to 20% mannans by total weight of the wood chips and from 15 to 20% xylans by total weight of the wood chips.

12. The method of claim 11, wherein said wood chips are destructured wood chips having an average weight per chip in the range of from 0.8 to 2 g.

13. The method of claim 12, further comprising the step of compressing wood chips to form said compressed wood chips.

14. The method of claim 13, further comprising the step of steaming wood chips prior to the step of compressing the wood chips, and wherein the average size of wood chips prior to compression is between 15 to 35 mm long by 15 to 35 mm wide and between 2 to 8 mm thick.

15. The method of claim 14, wherein said step of compressing wood chips includes subjecting the chips to a pressure in the range of from 50 to 600 atm.

16. The method of claim 15, wherein said step of compressing wood chips includes compressing the wood chips by at least 10% of uncompressed volume.

17. The method of claim 16, wherein the enzymatic activity of said CBH is at least 150 FPU per gm of wood chips.

18. The method of claim 17, wherein the step of compressing wood chips includes compressing the wood chips with a screw clamp, or press or a hydraulic press.

19. The method of claim 18, wherein said step of compressing wood chips comprises subjecting the chips to pressure for a period of between 10 minutes and 5 hours.

20. The method of claim 19, wherein said step of compressing wood chips is conducted prior to exposing of the compressed wood chips to the enzymatic solution.

21. The method of claim 20, wherein said step of compressing wood chips is conducted in the presence of the enzymatic solution.

22. The method of claim 21, wherein exposing the compressed wood chips includes permitting the wood chips to decompress at atmospheric pressure in an aqueous solution to a final consistency in the range of from 0.3 to 30%.

23. The method of claim 1, further comprising the step of chipping raw wood material to form wood chips prior to the compressing step.

* * * * *